US005727577A

United States Patent [19]

Post

[11] Patent Number: 5,727,577

[45] **Date of Patent: *Mar. 17, 1998**

[54] OPTICAL ORNAMENT

[76] Inventor: James M. Post, 303 NE. 8th Ave., Gainesville, Fla. 32601

[ * ] Notice: The term of this patent shall not extend beyond the expiration date of Pat. No. 5,573,017.

[21] Appl. No.: 657,085

[22] Filed: Jun. 3, 1996

Related U.S. Application Data

[63] Continuation-in-part of Ser. No. 507,891, Jul. 27, 1995, Pat. No. 5,573,017.

[51] Int. Cl.[6] ..... A45D 8/12

[52] U.S. Cl. ..... 132/275; 362/103; 446/219

[58] Field of Search ..... 132/275; 385/119, 385/33, 35; 362/103, 104, 105, 106; 446/219

[56] References Cited

U.S. PATENT DOCUMENTS

| | | | |
|---|---|---|---|
| 2,933,853 | 4/1960 | Lavel, Jr. | 446/219 |
| 3,501,628 | 3/1970 | Madden . | |
| 3,675,005 | 7/1972 | Curiel | 362/103 |
| 3,758,771 | 9/1973 | Frohardt et al. . | |
| 4,655,721 | 4/1987 | Loomis et al. | 446/219 |
| 4,722,582 | 2/1988 | Modone et al. | 385/35 |
| 4,998,186 | 3/1991 | Cocca . | |
| 5,118,319 | 6/1992 | Smith et al. | 446/219 |
| 5,377,287 | 12/1994 | Lee et al. | 385/35 |
| 5,477,433 | 12/1995 | Ohlund | 362/104 |
| 5,497,307 | 3/1996 | Bae et al. | 362/104 |

*Primary Examiner*—Gene Mancene
*Assistant Examiner*—Pedro Philogene
*Attorney, Agent, or Firm*—Saliwanchik, Lloyd & Saliwanchik

[57] ABSTRACT

An optical ornament is provided utilizing optic fibers, which can be attached to clothing, hair, a person's body, an animal, or an object. Light is received and focused onto a plurality of optic fibers which can be extended outwardly, whereby the optic fibers are illuminated in the absence of added electrical energy. Decorations such as gemstones, artificial flowers, and the like are provided to decorate the optical ornament and to color the light transmitted through the fibers.

18 Claims, 11 Drawing Sheets

Fig. 3A
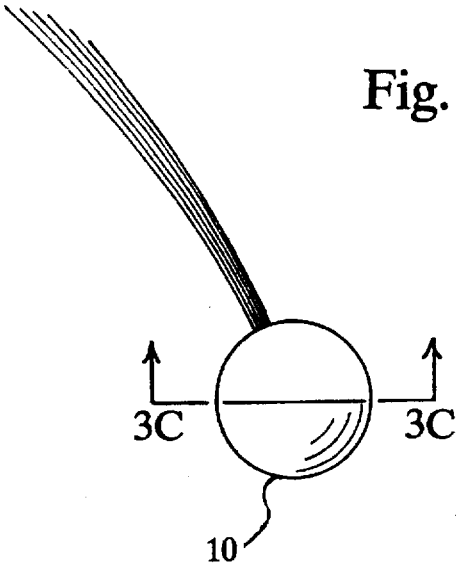
Fig. 3C
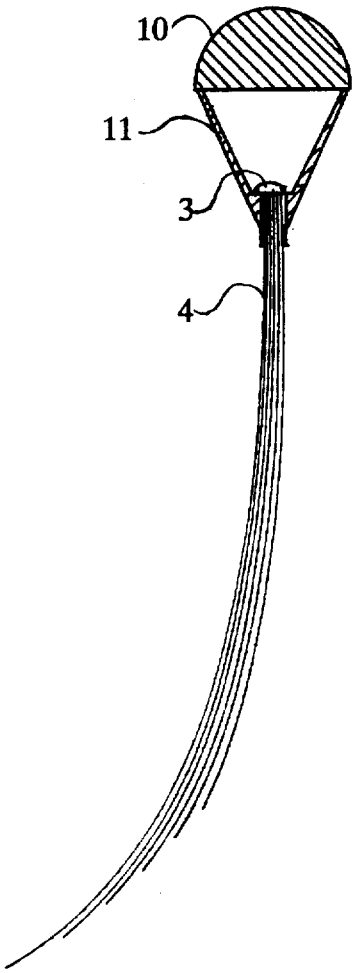
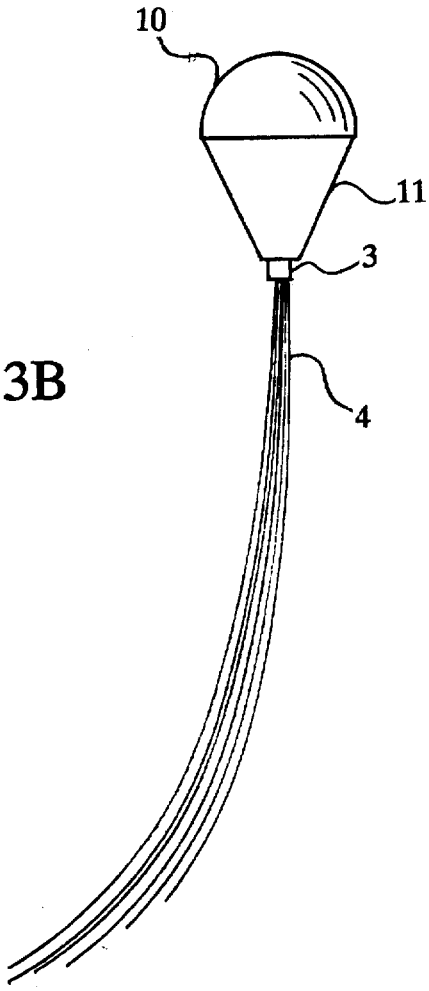
Fig. 3B

OPTICAL ORNAMENT

CROSS-REFERENCE TO A RELATED APPLICATION

This is a continuation-in-part of application Ser. No. 08/507,891, filed Jul. 27, 1995 now U.S. Pat. No. 5,573,017.

BACKGROUND OF THE INVENTION

1. Field of the Invention

This invention relates generally to an illuminated ornamental device suitable for decoration of the body, hair, clothing, animals, toys or other objects, preferably utilizing fiber optics as an integral part of the device, requiring no electrical source for its operation.

2. Description of the Prior Art

Hair decorations of many varieties are well known in the art. Such decorations are normally held by hair barrettes, clips, combs, or a variety of like means used to temporarily secure ornaments or decorations to the hair.

Specifically, illuminating ornamentation and decorations are also known in the prior art. For example, U.S. Pat. No. 3,501,628, discloses an illuminated hair ornament that provides tiny lamps placed throughout the hair to give an illuminated or sparkling effect. The lamps are operated by a battery housing through the use of concealed wires which are connected thereto. The device tends to be cumbersome and is a problem in that considerable attention must be paid to properly placing the device and the individual lamps in one's hair. In addition, the battery must be replaced as its stored power becomes depleted.

In a similar fashion, the device of U.S. Pat. No. 3,758,771, is used to illuminate a wig through the use of fiber optic members. The light emitting ends of the fibers are interspersed throughout the hair and connect to a miniaturized light source made of a battery, an electric lamp, and a switch. The device is cumbersome and not practical for routine use to decorate the hair.

In U.S. Pat. No. 4,998,186, a decorative hair ornament was described in which a light source was provided for illuminating optical fibers. The light source required provision of electrical energy, such as from a 3.5 V battery. That invention therefore has the attendant problems of having to obscure the electrical source. It also requires replacement of spent electrical sources. The instant invention overcomes these disadvantages.

A number of toys with electrically illuminated parts including eyes, are known in the art. No example of a toy having illuminated eyes without input of electrical energy, as disclosed herein, has been identified.

Within the prior art there have been no ornamentation devices that feature an illuminated effect which can be quickly and efficiently attached to the hair. The devices of the prior art, because of their designs, must be very carefully placed in one's hair so as to conceal either wires, a light source, batteries, or a combination of elements that are not intended to be a part of the sought after aesthetic effect. Likewise for toys and items of jewelry, no electrical energy free illuminated devices have been identified.

BRIEF SUMMARY OF THE INVENTION

The instant disclosure describes an invention that provides an illuminated decorative item for a person's head, body or clothing, or for a toy or jewelry using fiber optics, (optical fibers). The device is comprised of a light capturing device or panel, such as a lens or a reflecting concentrator such as a parabolic reflector, generally oriented toward the sun or artificial light, a light coupling device or assembly to couple the emitted light into the multiple proximal ends of the radiating optical fibers and a headband, comb, article of clothing, or other item for attachment or proximity to the head, body or clothing. All of the above can be obscured by the hair, clothing or body or displayed. The radiating fibers are dimensioned so that they can be combed into the hair mass, worn as clothing or attached to the body, clothing, shoes, to toys or other objects, or to an animal. Additional features include provisions for varying the color or light either individually or collectively in the optical fibers. Varying light colors can be provided by the inclusion of a splitting prism to provide the colors of the spectrum, or use of colored glass, plastic or the like, and the placement of the proximal ends of the fibers will determine the color.

In use, the fibers are distributed such that the distal ends of the optical fibers are displayed. Light emission takes place only at the distal end of each fiber, creating a point of light.

Accordingly, it is an object of the invention to provide an optical ornamental hairpiece or ornamental device suitable for decoration of the clothing or body or toys requiring no added electrical energy for operation, and which is interesting, attractive and easy to attach.

It is another object of the invention to provide an optical ornamental hairpiece that utilizes optic fibers in a decorative pattern and which requires no added electrical energy for operation.

It is another object of the invention to provide an optical ornamental hairpiece in which the light source for the fiber optics is a light receiving means which is integral to the hairpiece.

It is still another object of the invention, utilizing the principles of focussed natural or artificial illumination, to provide flashing and illuminated eyes for children's toys or sports mascots or hand puppets.

These and other objects are accomplished by, for example, an optical ornamental hairpiece utilizing optic fibers. The fibers may be inserted into a protective tubing containing a light receiving means. The light receiving means is adhered to hair fastening means by an adhesive, detachable means, or other convenient means.

Decorative means such as gemstones, flowers, or fabric designs can be provided to decorate the hairpiece combining the fiber optics and hair fastening means.

Illuminated eyes for a toy are provided by inclusion of the herein described optics into the head-region of the toy.

Illuminated articles of jewelry are provided by fashioning the optical elements disclosed herein into the body of the decorative piece for example, such that light emitted by the optical fibers is refracted and reflected by the facets of gemstones, plastic, glass or like decorative means.

Another object of this invention is to provide a novel tree lighting device which employs the optical principles of this invention to decorate a tree using a single or a few sources of light.

These and other objects will become apparent from a review of the complete disclosure.

BRIEF SUMMARY OF THE FIGURES

In accordance with these and other objects which will become apparent hereafter, the invention will now be described with reference to the accompanying drawings in which:

FIG. 3A is a plan view showing an alternate configuration of an ornamental hairpiece in the form of a focussing hemi-sphere and support structure which is constructed in accordance with the invention.

FIG. 3B is an elevational view showing an alternate configuration of an ornamental hairpiece in the form of a focussing hemi-sphere and support structure which, is constructed in accordance with the invention.

FIG. 3C is a sectional view, along line 3 C of FIG. 3A, showing an alternate configuration of an ornamental hairpiece in the form of a focussing hemi-sphere and support structure which is constructed in accordance with the invention.

DETAILED DESCRIPTION OF THE INVENTION

Figure 1A:
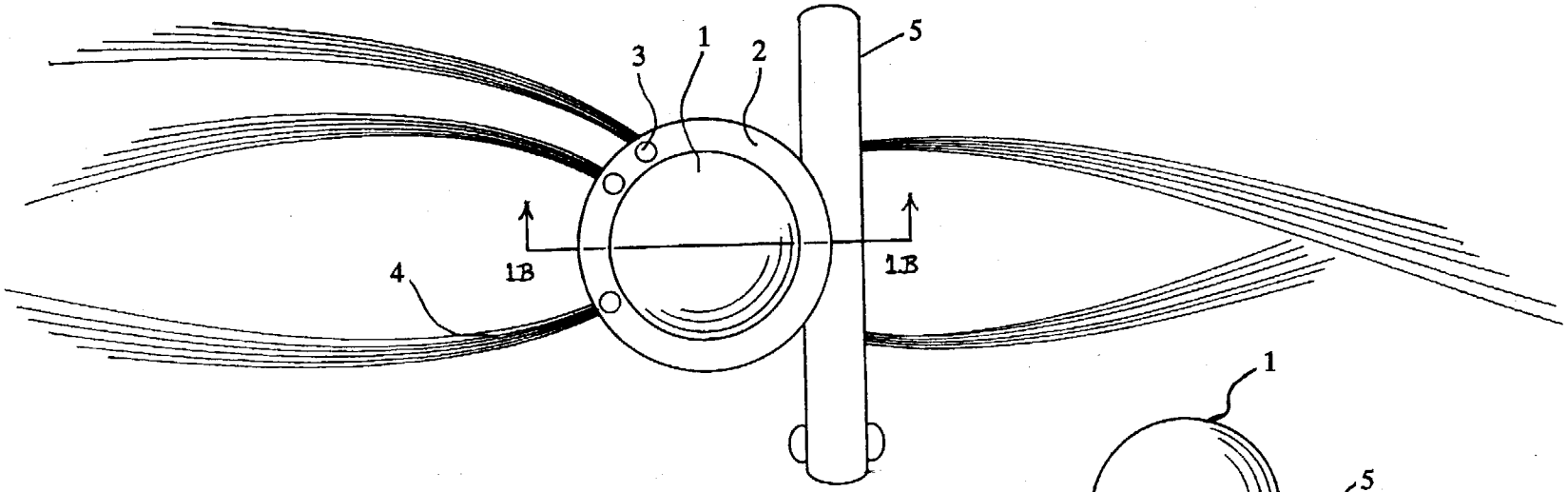
FIG. 1A is a plan view showing an optical ornamental hairpiece in the form of a focussing sphere as part of a hair clamp which is constructed in accordance with the invention.
Figure 1C:
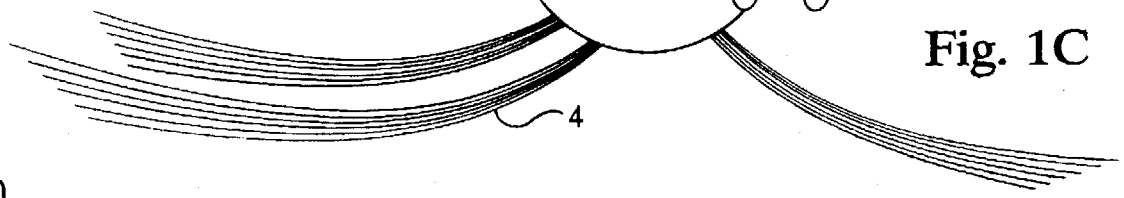
FIG. 1C is an elevational view showing an optical ornamental hairpiece in the form of a focussing sphere as part of a hair clamp which is constructed in accordance with the invention.
Figure 1B:
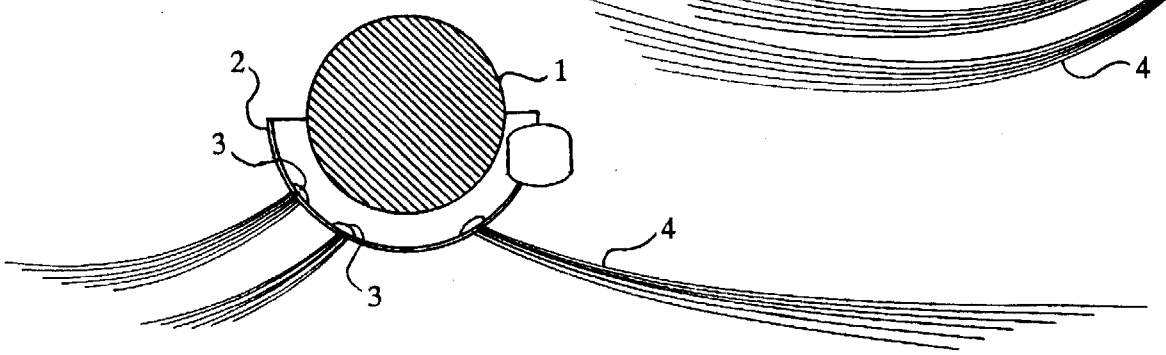
FIG. 1B is a sectional view, along line 1B of FIG. 1A, showing an optical ornamental hairpiece in the form of a focussing sphere as part of a hair clamp which is constructed in accordance with the invention.

With reference to FIG. 1, a first embodiment of this invention is provided as an ornamental hairpiece comprising a light receiving and focusing means which is shown as a full transparent sphere 1, a housing which acts as a support structure 2, optical fiber support, attachment and light modifying means 3, optical fiber bundle 4 and a fastening means 5 are shown. The fastening means as illustrated is a standard hair clip used in the customary fashion. Other means for attachment are, naturally, within the scope of this invention.

In use, it is desirable that any source of light in the surroundings of the wearer be received, captured, concentrated, and directed onto the proximal ends of the optical fibers. The full sphere optical element lends itself to these requirements. Light rays from sources within the upper hemisphere surrounding the wearer are focussed onto a spherical surface defined by the inner surface of support structure 2. As the apparent position of the light source varies, either as a result of actual motion of the light source or as a result of head motion by the wearer, the focussed point of light scans the inner surface of the housing 2. Referring to FIG. 1, it can be observed that optical fiber attachment means 3 is positioned such that the scanning light point intercepts the proximal ends of the fibers and the light is propagated into the fibers. Ideally, the proximal ends of the fibers are situated at or near the focal point of the light receiving and focusing means 1. Color selection can be accomplished by varying the composition of item 3 by a colored member made of glass, plastic or like light transmissive element. Alternatively, optical fibers of differing colors may be used. Only three fiber bundles are illustrated for clarity. In practice, many bundles are installed and are selectively illuminated by the scanning point of light. Each bundle can have a different color. The distal ends of the fibers are arranged in the wearers hair and transmit intense flashes of varicolored light as the wearer moves or as a result of head motion.

Figure 2A:
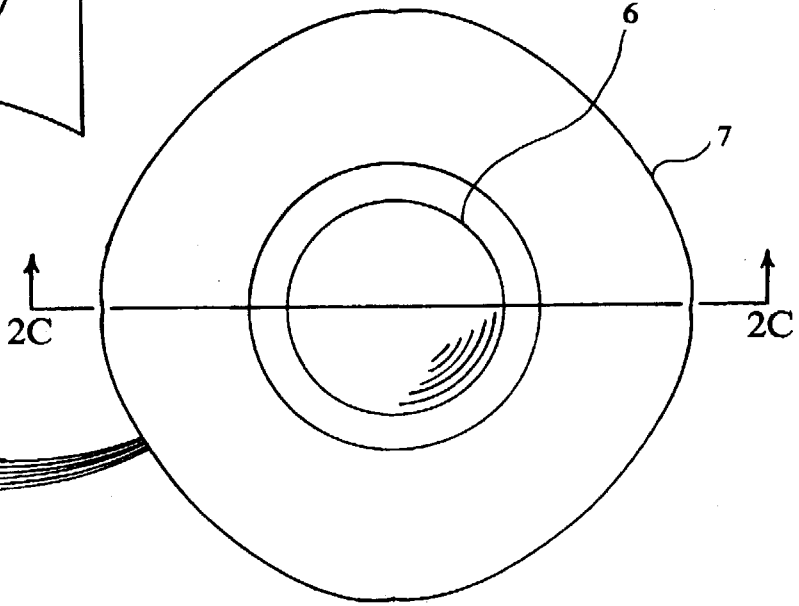
FIG. 2A is a plan view showing an alternate configuration of an ornamental hairpiece in the form of a focussing sphere utilizing a crown-like structure which is constructed in accordance with the invention.
Figure 2B:
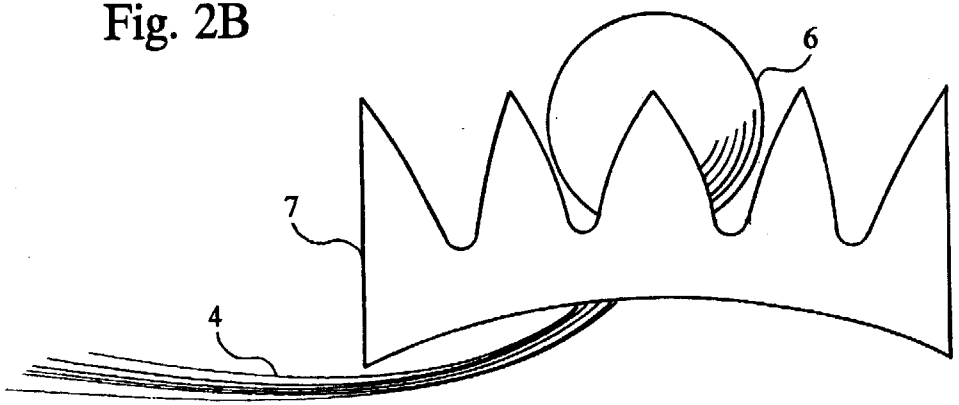
FIG. 2B is an elevational view showing an alternate configuration of an ornamental hairpiece in the form of a focussing sphere utilizing a crown-like structure which is constructed in accordance with the invention.
Figure 2C:
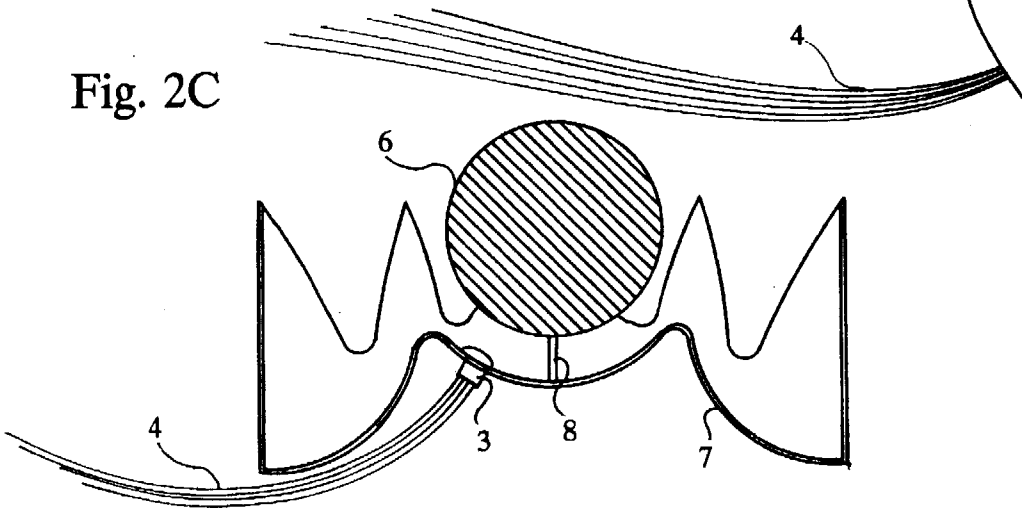
FIG. 2C is a sectional view along line 2C of FIG. 2A showing an alternate configuration of an ornamental hairpiece in the form of a focussing sphere utilizing a crown-like structure which is constructed in accordance with the invention.

With reference to FIG. 2, another embodiment of the ornament comprising a spherical light receiving and focusing lens is shown. Sphere 6, support and decorative crown-shaped housing 7, sphere attachment means 8, fiber bundle 4 and fiber support, attachment and light modifying means 3 are combined as a variation of the basic invention. The entire assembly can be affixed in the wearer's hair by a variety of means, including clips, bands or combs. The shape of the housing 7 may, obviously, be of any decorative shape.

Referring to FIG. 3, a variation of the basic invention is illustrated, using a hemi-sphere for the concentrating optical element. Hemi-sphere 10, housing 11, fiber bundle 4 and fiber support, attachment and light modifying means 3 are combined in accordance with the basic features of this invention. In practice, multiples of the hemi-sphere assembly are combined into one decorative item, with each element optionally radiating different colors. Clusters of the elements shown in FIG. 3 may be combined to form, for example, flower shaped arrangements or any other decorative design for attachment to clothing, hair, toys, or other objects.

Figure 8A:
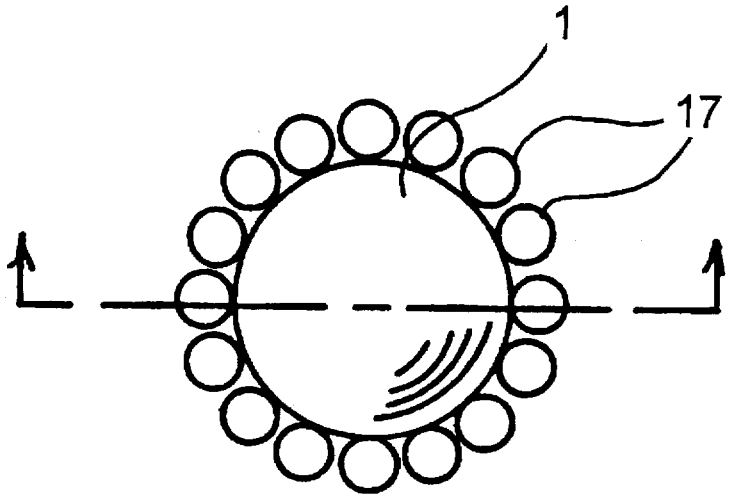
FIG. 8A shows one embodiment of a piece of jewelry incorporating the optics of this invention.
Figure 8B:
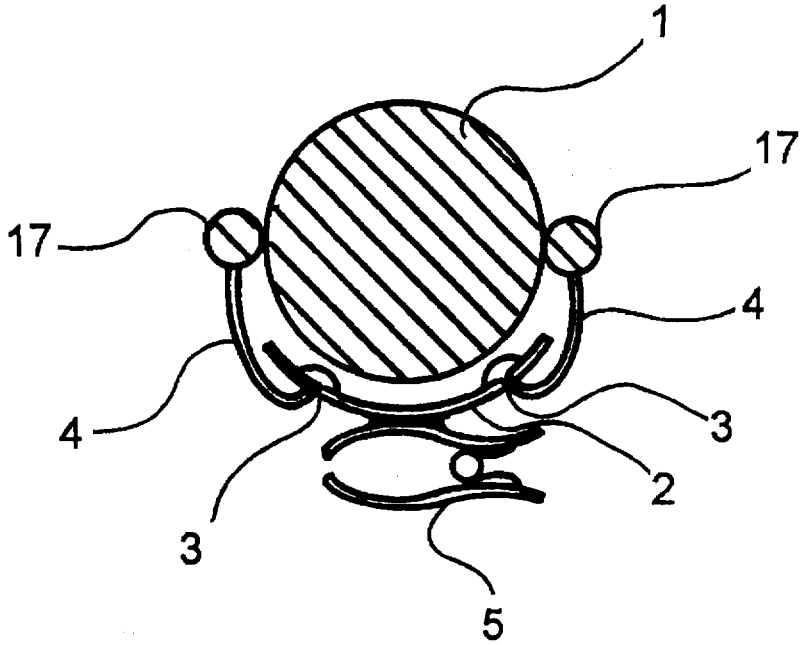
FIG. 8B shows a cross-sectional view of the embodiment of optically-enhanced jewelry shown in FIG. 8A.

As one example of this, shown in FIGS. 8A and 8B a piece of jewelry may be produced incorporating the optics of this embodiment of the invention. The fight receiving and focusing means 1 in this embodiment may be a spherical optical element below which a plurality of optical fiber support, attachment and light modifying means 3 are affixed and housed by housing and support structure 2. Optical fiber bundles 4 run from the underside of the housing 2 to the distal ends of the fibers which may be affixed to light emitting spheres 17 arranged about the central light collecting sphere 1. A fastening means 5, such as a clip or like means, provides a method for attaching the device to clothing, shoes, a toy, an animal or any other object.

In an alternate embodiment, the sphere 1 is replaced with a faceted gemstone, and the optics are reversed, with each of the light emitting spheres 17 acting as a light receiving and focusing means such that light is transmitted out of the distal ends 3 and refracted within the gemstone to provide brilliance thereto.

Current practice using faceted or cabochoned natural or synthetic materials has three basic limitations that restrict the brightness and color of jeweled items. First, the light gathering ability of current jewels is limited by the frontal projected area of the actual stone. This limitation places a basic restriction on the maximum brightness of the reflection. Second, depending upon the incident angle of the impinging light, some fraction of light is reflected from the surface of the jewel and may not be reflected to the eye of the observer. Those rays are lost to the observer and do not increase the apparent brightness of the jewel. The remaining fraction of incident light is absorbed by the jewel. If the back surface of the jewel is faceted, some of the light will be reflected from the internal surfaces of the facets and a portion will be directed back to the eye of the observer. Depending upon the index of refraction of the jewel material, some wave interference will take place and color flashes may be obtained. Gem cutters select the material and facet geometry to increase the "fire" and brightness of the finished jewel. In some faceting geometry, coupled with prong mounting, some light may be admitted to the jewel through the reverse side facets, but again reflection and incident angles limit the effect. Third, the colors, as seen by the observer, are influenced by the impurities included in the basic material of the stone and also by constructive/destructive wave interference within the jewel. The faceting geometry also affects the color of the observed light. Accordingly, the designer of conventional jewelry has only limited control of these parameters.

Variations on the basic optical principles disclosed herein make available for the jewelry designer control over certain parameters that enhance the intrinsic brightness and color of natural and synthetic jewels. These parameters include control over the light capturing area of the jewelry and control over the colors of the emitted light as seen by the observer. In addition, selective flashing of intense light of multiple colors lends a dimension to jewelry design that has not heretofore been available. By including the light capturing device of this invention into jewelry as part of the design, permits increases in intensity of up to one hundred fold or more.

The central element of the design of the novel jewelry disclosed herein is the collecting sphere. A transparent acrylic sphere, for example, has excellent optical qualities and can present to the ambient light a projected area many times that of the projected area of even a large natural stone.

The actual design of the jewelry item can take many forms, including but not limited to personal adornment items, floral arrangements in which the radiating element is made to resemble parts of flowers, containers for perfume or soap, automotive items to personalize automobiles such as hood ornaments, chandeliers for home or business use. Other applications include two- and three-dimensional art items that use color and intensity for novel effect.

In operation, ambient light, either artificial or natural, impinges upon the collecting sphere, is concentrated by internal reflection and is focused upon the focal plane. As relative motion occurs between the light source and the collection sphere, either as a result of light motion or motion of the device, the focal point scans across the focal plane and intercepts the proximal ends of the fiber optic bundle. Color modification may take place at this point. The concentrated light then propagates down the fiber bundle as a result of multiple internal reflections, where it is emitted at the distal end of the bundle. The distal ends are located at the focal point of the terminating sphere. The concentrated light is then reradiated into the environment where it is observed.

The various decorative effects that are possible with this device result from the grouping, shape, color and other attributes of the terminal device. For instance, the terminal devices can be grouped around the collecting sphere, as shown in FIG. 8, to form an item of jewelry. Obviously, reflective materials of various shapes can be grouped around the terminal radiators to enhance the effect by redirecting some of the back radiation toward the viewer, in addition to the direct radiation.

The above mentioned items of jewelry can be fabricated using discrete shapes, such as spheres, cabochons, faceted jewels (either artificial or natural) or of shapes to resemble interesting characteristics to please the viewer or user. The discrete parts can be assembled using adhesives such as clear epoxy, or using support prongs as in conventional jewelry fabrication.

It is also possible to achieve low cost assembly by casting the entire device in one injection molding process. The light conducting fibers can then be added.

Following attachment of the optical fibers, the vinyl jacketing, as used on the bundles, are removed and the flexible fibers are folded and dressed against the back of the item. They are then molded into the material that forms the attachment device. This folding decreases the thickness of the item.

Figure 4A:
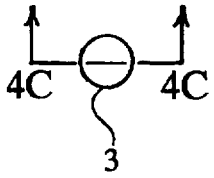
FIG. 4A is a plan view showing an attachment means for holding fiber optic bundles and for providing light modifying means.
Figure 4B:
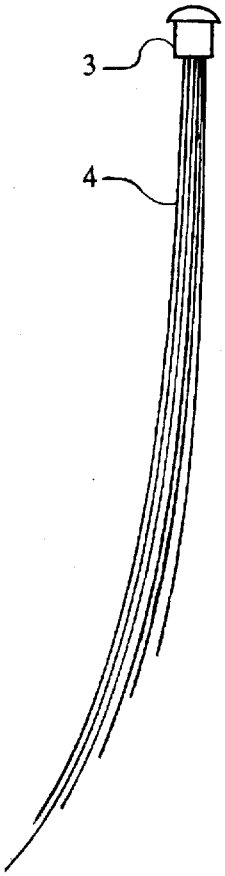
FIG. 4B is an elevational view showing an attachment means for holding fiber optic bundles and for providing light modifying means.
Figure 4C:
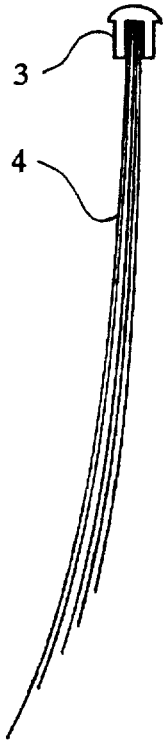
FIG. 4C is a sectional view, along line 4 C of FIG. 4A, showing an attachment means for holding fiber optic bundles and for providing light modifying means.

FIG. 4 illustrates the means 3 for support and attachment of the optical fiber bundles 4 and for modifying the light. A molded plastic shape 3, with integral color is provided, to which the optical fiber is attached with adhesive. The assembly is installed into any appropriate housing such as 2, 7, or 11, as described above. There is no need to provide light modification in the fiber attachment means 3 if the fibers themselves are colored.

A further variation of the basic invention provides illuminated and flashing eyes for a child's toy, sports mascots, puppets, or other objects. Referring to FIG. 5, two transparent spheres 13 are interconnected via an optical fiber or optical fiber bundles 15. Sphere 13, support housing structure 14, optical fiber bundle 15 and fiber support, attachment and light modifying means 3 are combined to form an optical device that intercepts light rays, and which concentrates and focuses the rays onto the proximal ends of the optical fiber(s) 15 and redirects the energy out of the assembly. The device performs in either direction, with either sphere acting both as a light receiver or as a light transmitter.

The optical ornament according to this invention may be attached by any fastening means to the body of a person or animal, to clothing, shoes, toys or other objects. Those skilled in the art will appreciate that any fastening means may be used without departing from this invention.

Figure 5B:
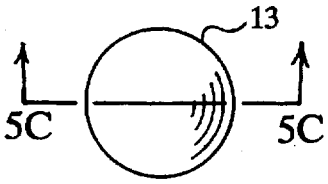
FIG. 5B is a plan view showing interconnected spheres and support structures suitable for providing illuminated eyes for toys, sports mascots and puppets.
Figure 5C:
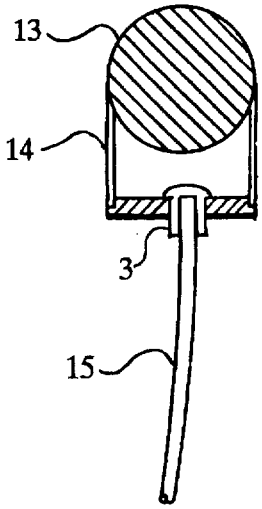
FIG. 5C is a sectional view, along line 5C of FIG. 5B, showing interconnected spheres and support structures suitable for providing illuminated eyes for toys, sports mascots and puppets.
Figure 5A:
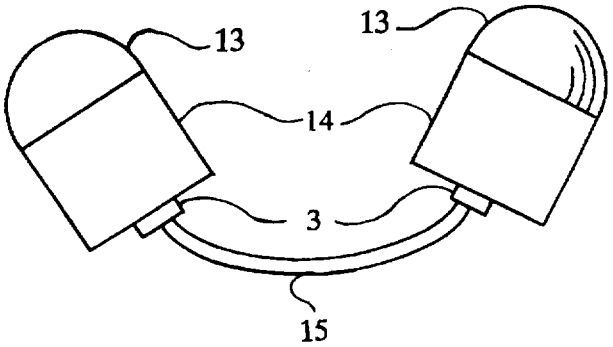
FIG. 5A is an elevational view showing interconnected spheres and support structures suitable for providing illuminated eyes for toys, sports mascots and puppets.
Figure 5D:
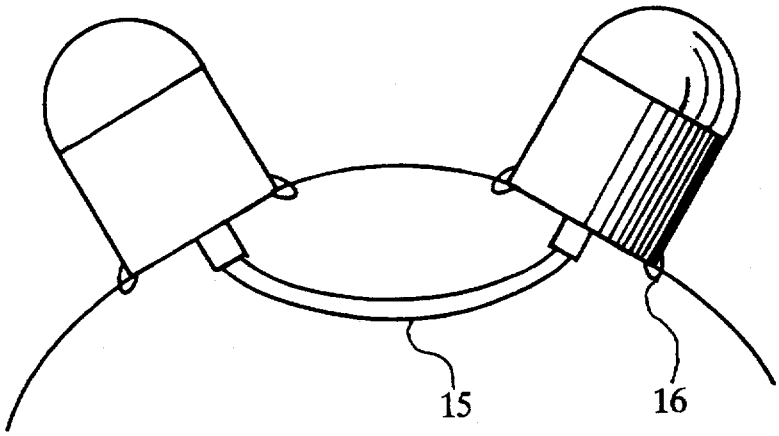
FIG. 5D is an elevational view showing interconnected eyes of FIG. 5A attached to the surface of a toy's head by being sewn into place.
Figure 5E:
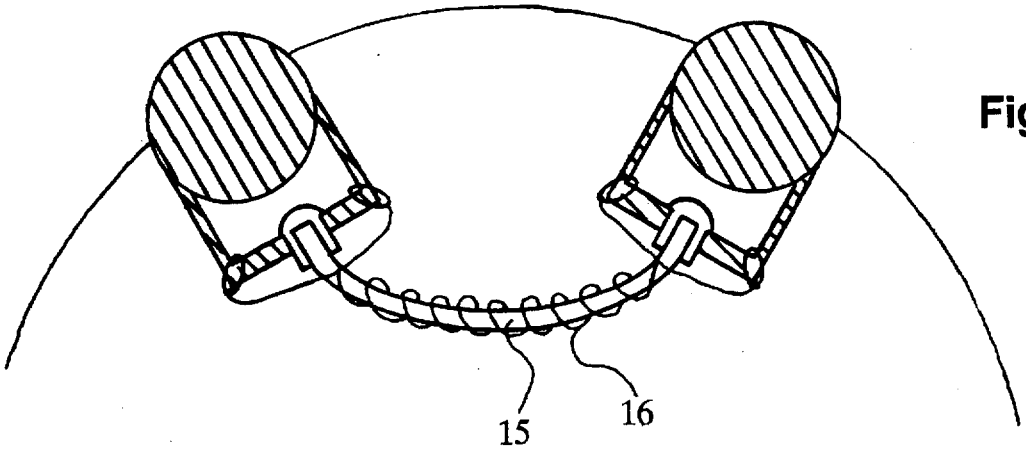
FIG. 5E is a cross-sectional view showing interconnected "eyes" recessed in the head portion of a child's toy.

In FIG. 5D, an elevational view is provided showing the interconnected eyes of FIG. 5A attached to the surface of a toy's head by being sewn into place, for example, at points 16. Alternatively, the optics may be recessed into the head of the toy and sewn into place at points 16, or by passing thread over and around the optical fiber bundle 15 (not shown). FIG. 5E shows the embodiment of FIG. 5D in cross section.

Figure 6A:
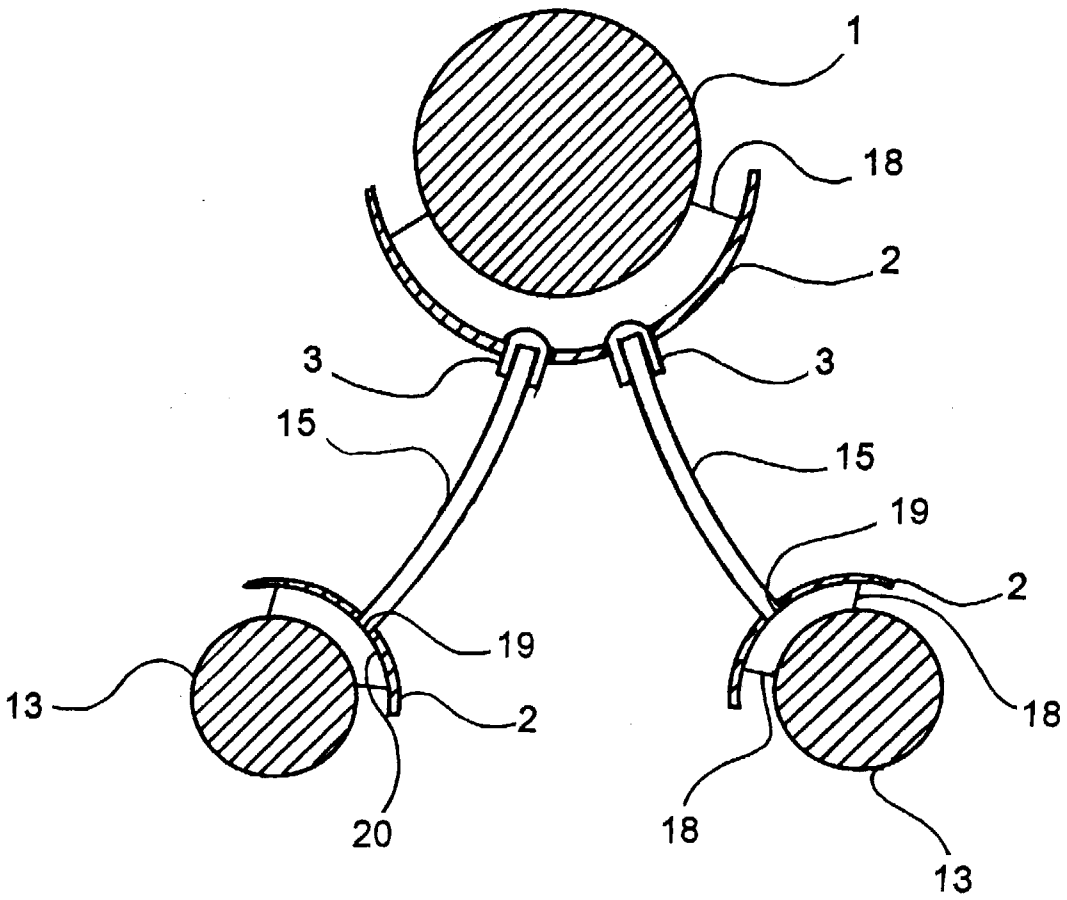
FIG. 6A shows an alternate embodiment for the optics which may be used in a toy to provide illuminated eyes in cross-section.
Figure 6B:
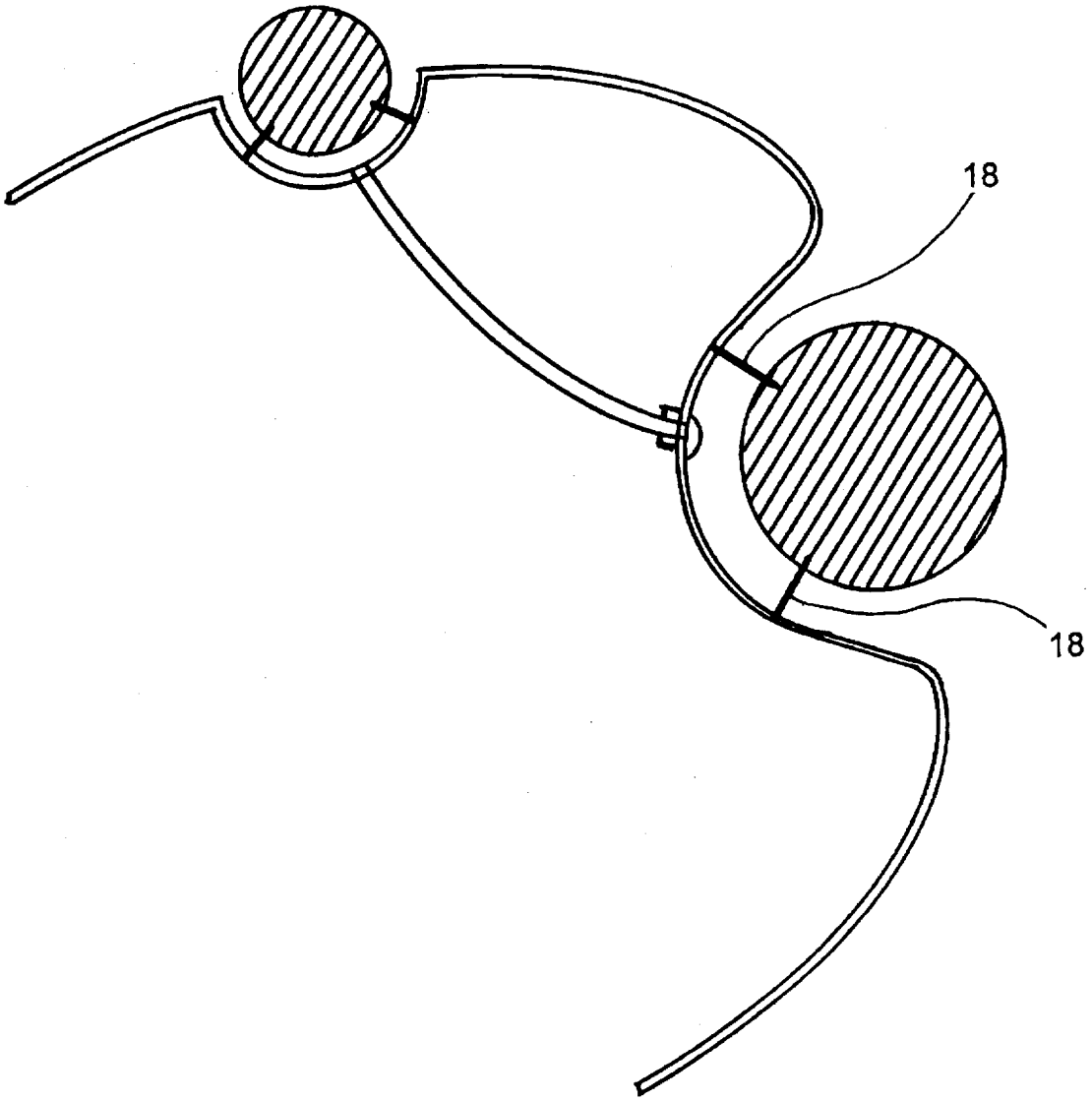
FIG. 6B shows a cross-sectional view of the optics shown in FIG. 6A within a larger object, such as the head of a child's toy.

In FIG. 6A, an alternate embodiment of the optics for the eyes of a child's toy is shown. In this embodiment, rather than having the optical fiber 15 running between the "eyes" 13, the optical fiber 15 runs to a large light collecting sphere 1, retained in place by a housing 2, to which it may be affixed by attachment means 18. The light receiving and concentrating means 1 collects light in like fashion to that shown in FIG. 1, and transmits the collected light to the proximal ends of the fiber optic bundles affixed to the housing 2 by the affixing and light conditioning means 3. The large sphere 1 with its greater projected area, intercepts more light to transmit to the "eyes", resulting in light amplification and enhancement of the desired effect. The light is transmitted through the fibers 15 to the distal ends thereof 19 which emit light to illuminate the "eyes" 13, which are retained in a housing 2 by an attachment means 18. The housing at the distal ends of the fibers may be in the shape of eye-sockets and the forward surface 20 of the housing may be silvered to maximize the amount of light reflected out of the "eye-socket". In FIG. 6B, the optics shown in FIG. 6A are shown in cross-section with the optics in-place within a larger object such as the head-portion of a child's toy. The toy may be any toy with eyes, and includes children's action figures, including but not limited to a "TERMINATOR" action figure, and various or other action figures.

Large sphere 1 receives ambient light, focuses and concentrates the light and directs the light to the focal plane represented by the inside surface of the housing. Relative motion between the device incorporating the sphere and light sources in the surrounding environment, (either natural or artificial), causes a scanning motion of the focal point across the focal plane. This scanning motion is used to advantage in the device, to cause flashing or to allow various and different colors to be displayed. Color may be introduced by selection of the fiber affixing means 3. Only one optical bundle 15 is shown for simplicity. In practice several or many optical fiber bundles may be used. The focal plane is preferably located at the focal point for displaying spheres 13.

Vacuum forming a thermoplastic material provides the outside surface of the device and the hemispherical concave surfaces as required for the focal planes, in one operation. Projections for supporting the spheres and maintaining the required positioning can be part of the molding process or added in a separate step. The fiber optic bundle incorporating a molded plastic shape for support and light modifying means 3 is shown in the figure. Obviously, the mounting surface can take any shape required by the application without varying or changing the basic optical provisions. Assembly may require the use of adhesive to affix the fiber optic assembly into the device.

Figure 7:
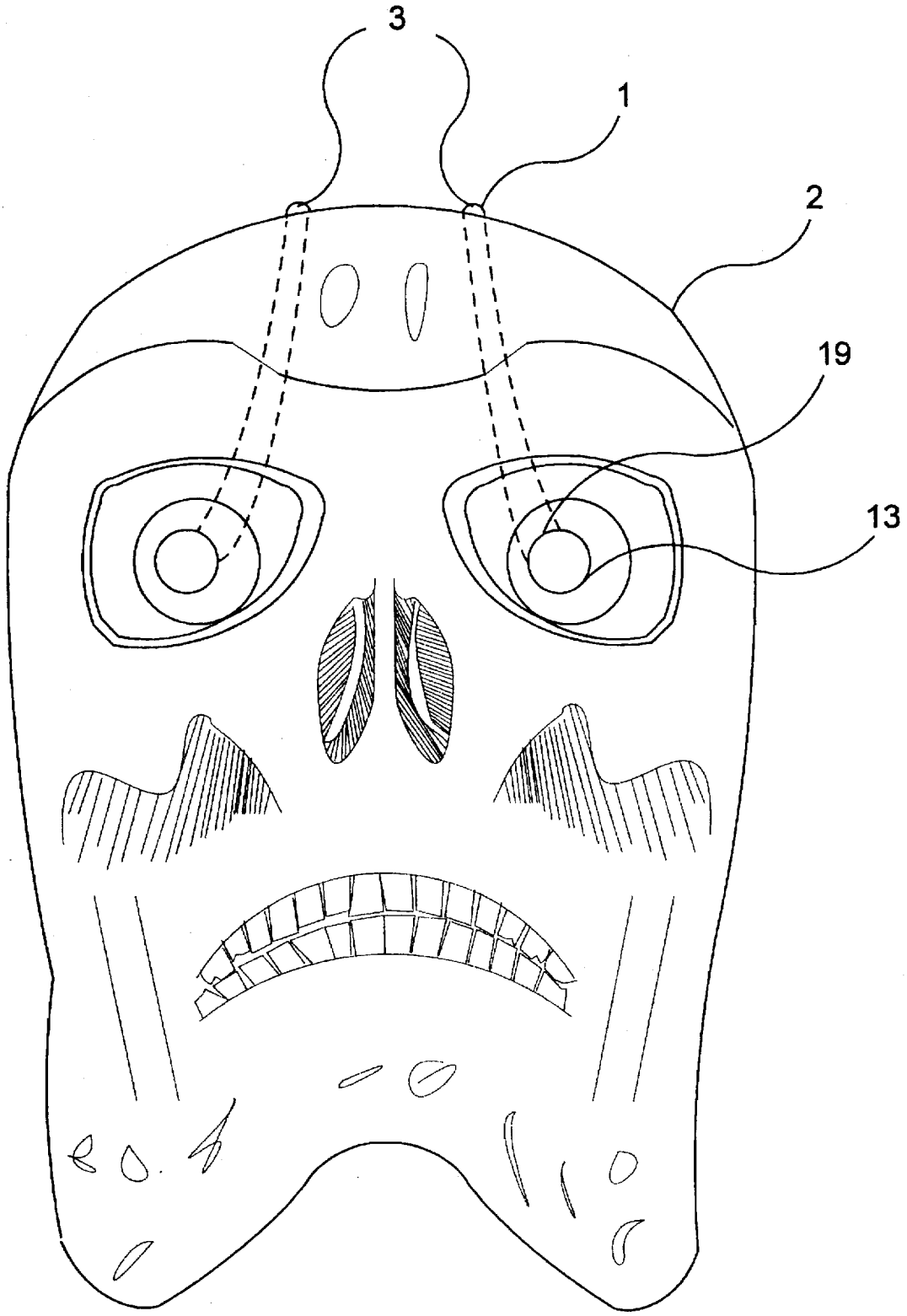
FIG. 7 shows a cross-sectional view of the head of a child's toy showing one embodiment of the optics of this invention.

In a further embodiment of this invention, the optics may be arranged as shown in FIG. 7. In this embodiment, shown in cross-section in FIG. 7, the optics are similar to those shown and described in FIGS. 6A and 6B. However, at the proximal ends 3 of the fiber optic bundles 15, the fibers are affixed in small light receiving and concentrating means in order to be unobtrusive. Accordingly, the optics of this embodiment may be molded into the head portion of a child's action figure at low cost and with high rates of production. The distal ends 19 of the fibers emit light to illuminate the "eyes" 13. The "housing" in this embodiment is the entire head 2, and the light receiving and concentrating means 1 may be just the proximal ends of the fibers or, molded into the head 2, there may be provided a lens or like means to enhance the level of light concentration.

Figure 9:
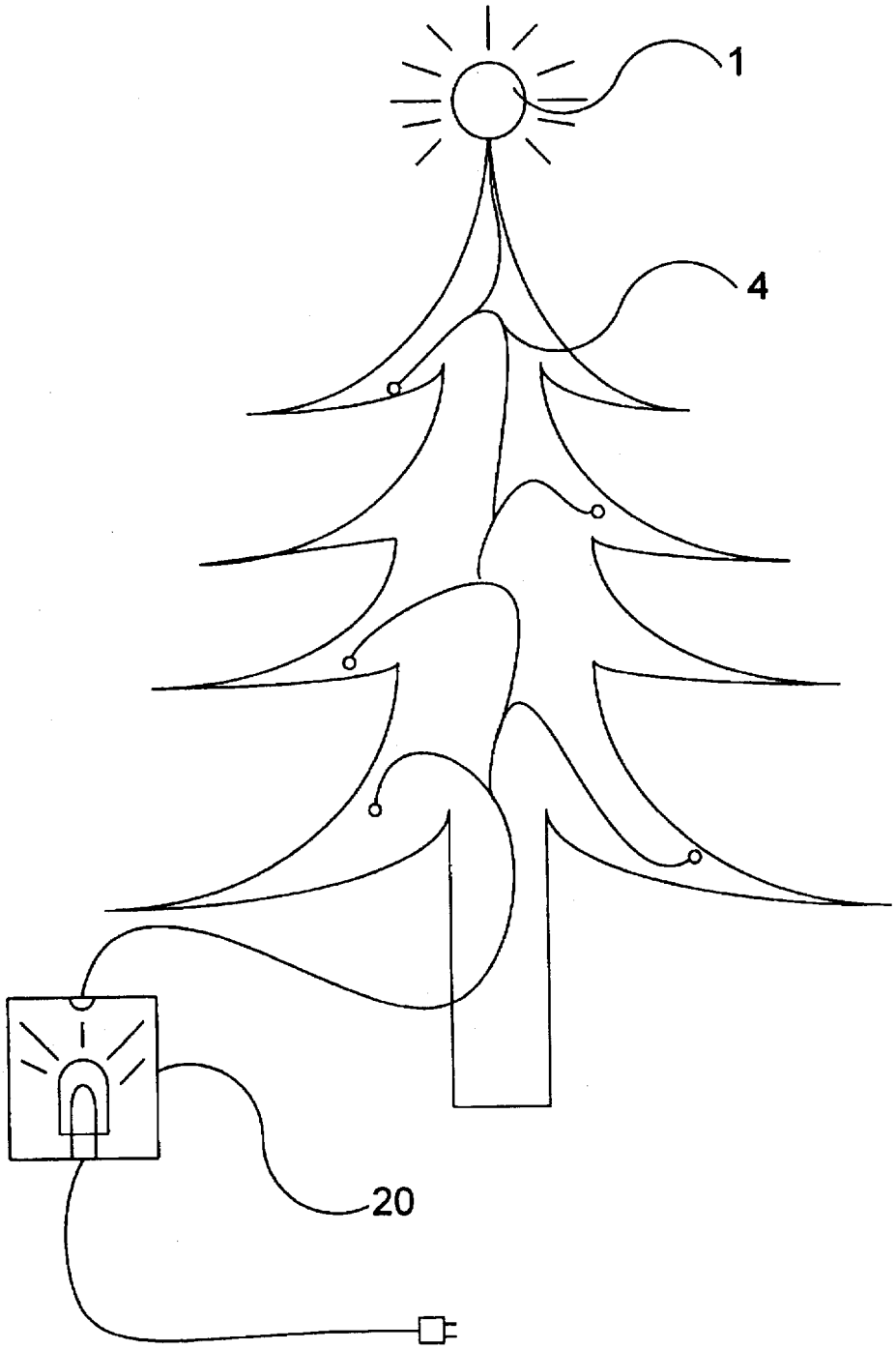
FIG. 9 shows an embodiment of this invention incorporating the optics of this invention into a Christmas tree decorating device.

In yet a further embodiment of this invention, shown in FIG. 9, there is provided a device incorporating the optics of this invention into a lighting and decorative means for a Christmas tree. According to this embodiment of the invention, light may be collected from the environment surrounding the tree by providing a light concentrating and collecting means 1, for example, in the form of a sphere at the top of the tree. Light thus collected is transmitted through fiber optic cables 4 running throughout the tree, to provide flashes of light through the tree at the distal ends 19 of the fibers. Alternatively, or in addition, a single or a plurality of electrical light sources 20 may be provided, with the light then being transmitted throughout the tree. The advantage of this embodiment of the invention being that only a single or a few light emitting devices, such as light bulbs, need be replaced. Naturally, this embodiment of the invention may be extended to decorative light emitting devices for the outside of homes or other buildings.

Figure 10:
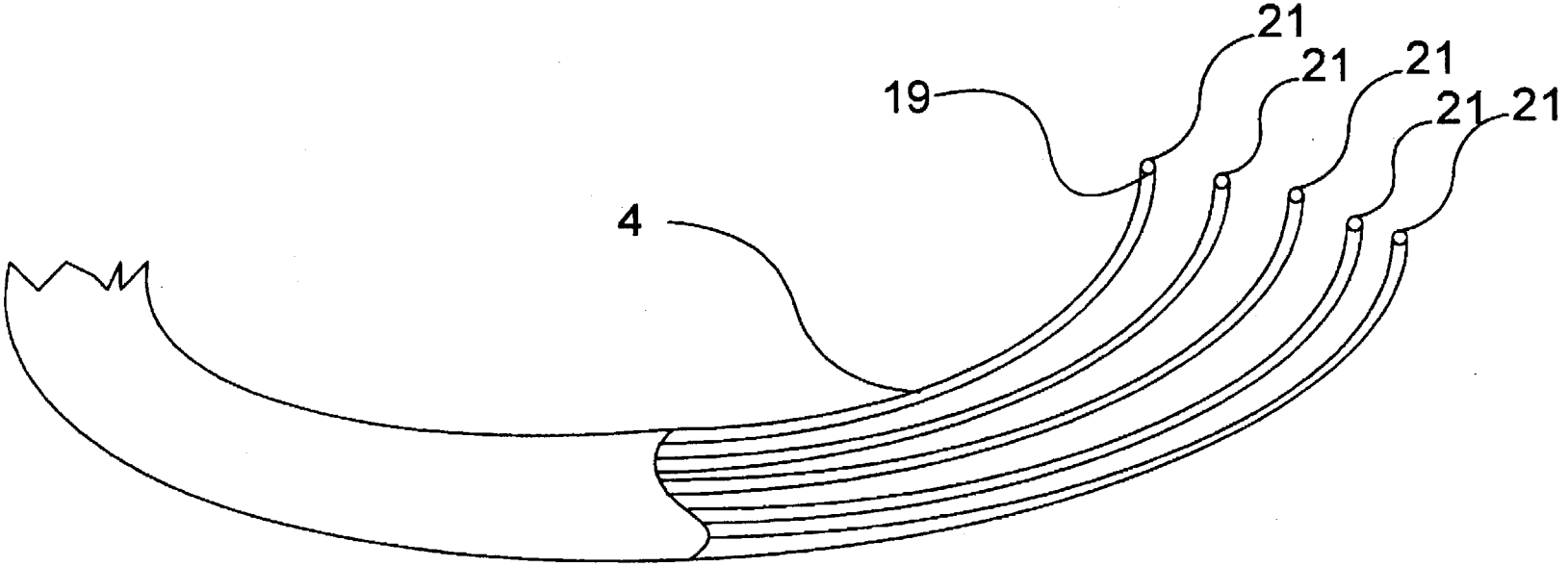
FIG. 10 shows an alternate embodiment of the optics of this invention wherein fiber-optic bundles are terminated with a spherical light-dispersing means to increase the angle of light dispersion from the distal ends of the optical fibers.

In FIG. 10, an improvement to any or all of the embodiments disclosed and described herein is provided by attaching spherical light dispersing means 21, at the distal ends 19 of the fibers 4. In this manner, a greater angle of light emission, and thus visibility of light conducted through the fibers, is achieved.

It will be appreciated that a variety of assemblies using various decorative and attachment means can be used in alternative embodiments of the basic invention. The invention can be provided in other forms without departing from the spirit or essential attributes hereof and accordingly, reference should be made to the following claims, rather than to the specifics of the foregoing specification, as indicating the scope of the invention.

REFERENCES

U.S. Pat. No. 3,501,628.
U.S. Pat. No. 3,758,771.
U.S. Pat. No. 4,998,186.

I claim:

1. An optical ornament requiring no added electrical energy for operation comprising:

a) means for fastening the ornament to a person's hair, clothing, shoes, body, to an object, or to an animal;

b) at least one light receiving means attached to said fastening means in such a way that light in the surroundings of the person, animal, or object to which said ornament is fastened will impinge on the proximal end(s) of at least one optical fiber;

c) said at least one optical fiber attached to said fastening means such that the proximal end(s) of said optical fiber(s) is/are situated such that light enters said proximal end(s) of the optical fiber(s) and is conducted from said proximal end(s) towards the distal end(s) of said optical fiber(s) such that the conducted light emanates from said distal end(s); and d) a housing which acts as a support structure for maintaining said light receiving means and said optical fiber(s) in appropriate juxtaposition with respect to each other and the light in the surroundings of said person, animal, or object to which said ornament is attached so that the light emanating from the distal end(s) of said optical fiber(s) is displayed.

2. The optical ornament of claim 1 wherein said fastening means is selected from the group consisting of a clip, a band, a comb, a crown, a means by which the optical ornament is sewn to or into an object, a means by which the optical ornament is molded into an object, and a means by which the optical ornament is intertwined within an object.

3. The optical ornament of claim 1 wherein said light receiving means is selected from the group consisting of a spherical lens, a hemi-spherical lens, and the exposed proximal end(s) of the at least one optical fiber.

4. The optical ornament of claim 1 wherein said optical fiber(s) attached to said fastening means is/are attached by means of a support, attachment and light modifying means.

5. The optical ornament of claim 1 wherein said at least one optical fiber is colored.

6. The optical ornament of claim 1 wherein said distal end(s) of said at least one optical fiber terminates in a light dispersive means.

7. The optical ornament of claim 4 wherein said support, attachment and light modifying means comprises an adhesive for binding the optical fibers to each other and to said fastening means, and a colored member made of glass, plastic or like material such that light entering said proximal end(s) of said fiber(s) first passes through said colored member such that light emanating from said distal end(s) of said fibers has the color of said colored member.

8. The optical ornament of claim 6 which is an ornament for the hair, such that the optical fiber(s) of the ornament when affixed to the hair via said fastening means may be combed into the hair to provide flashes of light as the wearer moves from one place to another or from one head position to another within a lighted surrounding.

9. The optical hair ornament of claim 8 wherein the end(s) of the optical fiber(s) proximate to the light receiving means is/are deployed below a colored member such that light entering said proximal end(s) of said fiber(s) first passes through said colored member such that light emanating from said distal ends of said fiber(s) has/have the color of said colored member, resulting in a hair ornament that displays varicolored flashes of light as the wearer moves.

10. The optical ornament of claim 1 when said ornament is incorporated in an object.

11. The optical ornament of claim 10 when incorporated in a child's toy requiring no added electrical energy for operation comprising:

a) at least one light receiving means attached to the toy in such a way that light in the surroundings of the child's toy to which said ornament is fastened will impinge on the proximal end(s) of at least one optical fiber;

b) said at least one optical fiber attached to said fastening means such that the proximal end(s) of said optical fiber(s) is/are situated such that light enters said proximal end(s) of the optical fiber(s) and is conducted from said proximal end(s) towards the distal end(s) of said optical fiber(s) such that the conducted light emanates from said distal end(s); and c) a housing which acts as a support structure for maintaining said light receiving means and said optical fibers in appropriate juxtaposition with respect to each other and the light in the surroundings of said child's toy to which said ornament is attached so that the light emanating from the distal ends of said optical fiber(s) is displayed; wherein the toy acts as the housing, and the combination of the light receiving means and the distal ends of the fiber(s) from which light emanates act as the eyes of the toy.

12. The optical ornament of claim 11 wherein the proximal end(s) of the fiber(s) is/are positioned below a light receiving and focusing means.

13. The optical ornament of claim 11 wherein the proximal end(s) of the fiber(s) is/are positioned at a surface of the child's toy so that light in the surroundings of the toy enters said proximal end(s) of said fiber(s).

14. The optical ornament of claim 11 which is an action figure.

15. The optical ornament of claim 11 wherein said distal end(s) of said optical fiber(s) are affixed to light transmissive spheres which thereby give the appearance of illuminated eyes.

16. The optical ornament of claim 10 in a piece of jewelry wherein a light receiving means at the proximal end(s) of at least one optical fiber conducts light entering said light receiving means through said optical fiber(s) to illuminate at least one light transmissive element incorporated into the piece of jewelry at the distal end(s) of said optical fibers(s).

17. The optical ornament of claim 10 in a piece of jewelry wherein at least one light receiving means at the proximal end(s) of at least one optical fiber conducts light entering said light receiving means through said optical fiber(s) to illuminate at least one faceted jewel incorporated into the piece of jewelry at the distal end(s) of said optical fiber(s).

18. The optical ornament of claim 10 in a tree ornament wherein, at said light receiving means, at least one source of electrically generated light is optionally provided such that light is conducted throughout the fiber(s) which is intertwined in a tree.

* * * * *

UNITED STATES PATENT AND TRADEMARK OFFICE

CERTIFICATE OF CORRECTION

PATENT NO. : 5,727,577

DATED : March 17, 1998

INVENTOR(S) : James M. Post

It is certified that error appears in the above-identified patent and that said Letters Patent is hereby corrected as shown below:

Column 7, lines 46: "and various or other action figures." should read --and various MARVEL comics or other action figures.--

Signed and Sealed this

Nineteenth Day of May, 1998

*Attest:*

*Attesting Officer*

BRUCE LEHMAN

*Commissioner of Patents and Trademarks*